US007402367B2

(12) United States Patent
Kitani et al.

(10) Patent No.: US 7,402,367 B2
(45) Date of Patent: Jul. 22, 2008

(54) ELECTROSTATIC IMAGE DEVELOPING TONER AND IMAGE FORMING METHOD

(75) Inventors: Tomoe Kitani, Hino (JP); Asao Matsushima, Hino (JP); Hiroyuki Kozuru, Otsuki (JP); Tomoko Tanma, Hino (JP)

(73) Assignee: Konica Minolta Holdings, Inc. (JP)

( * ) Notice: Subject to any disclaimer, the term of this patent is extended or adjusted under 35 U.S.C. 154(b) by 338 days.

(21) Appl. No.: 10/896,311

(22) Filed: Jul. 20, 2004

(65) Prior Publication Data

US 2006/0019186 A1 Jan. 26, 2006

(51) Int. Cl.
*G03G 9/08* (2006.01)

(52) U.S. Cl. ..... 430/108.1; 430/108.6; 430/110.3; 430/111.4

(58) Field of Classification Search ..... 430/108.1, 430/110.3, 111.4, 108.8, 108.6
See application file for complete search history.

(56) References Cited

U.S. PATENT DOCUMENTS 7,205,082 B2 * 4/2007 Matsushima et al. ..... 430/108.5
2002/0018952 A1 * 2/2002 Daimon et al. ..... 430/109.4
2002/0039699 A1 * 4/2002 Nishimori et al. ..... 430/137.11

FOREIGN PATENT DOCUMENTS

JP 408059840 * 3/1996
JP 11-194540 7/1999

OTHER PUBLICATIONS

Abstract of JP08059840.*
English langauge machine translation of JP408059840.*

* cited by examiner

*Primary Examiner*—Hoa Van Le
(74) *Attorney, Agent, or Firm*—Squire, Sanders & Dempsey L.L.P.

(57) ABSTRACT

A toner comprising a compound represented by the following formula:

$$R_1O(R_2O)_nH$$

where $R_1$ is an aliphatic hydrocarbon group having 10 to 22 carbon atoms or a distyrene-substituted phenyl group; $R_2$ is an alkylene group having 2 to 6 carbon atoms; and n is an integer of 1 to 15.

31 Claims, 2 Drawing Sheets

FIG. 1 ( a )
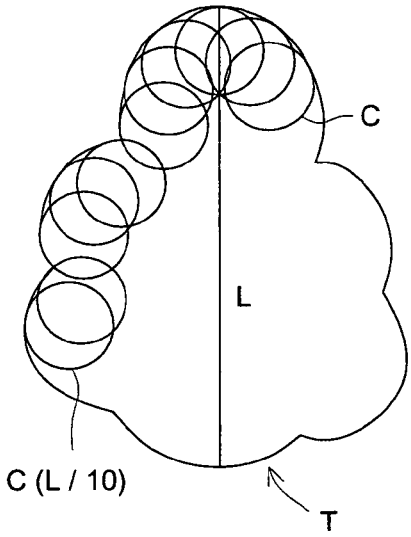
FIG. 1 ( b )
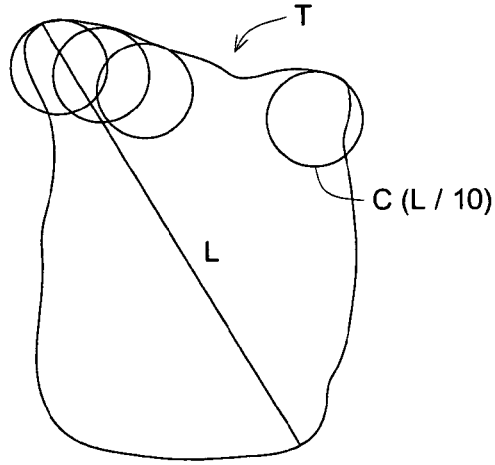
FIG. 1 ( c )
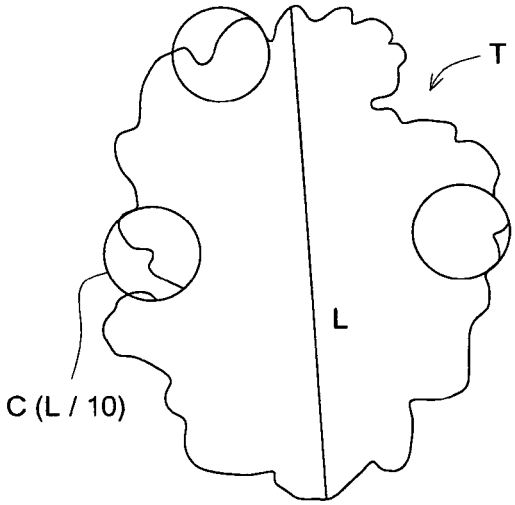

ELECTROSTATIC IMAGE DEVELOPING TONER AND IMAGE FORMING METHOD

BACKGROUND

1. Technical Field

The present invention relates to a toner for use in electrostatic image development and a preparation method thereof.

2. Related Art

Electrostatic image development as represented by electrophotography is broadly employed in imaging methods using printers, copiers or facsimile devices.

This is due to a very matured method whereby high quality images can be obtained at a high speed but some problems still remain. In a conventional toner prepared by a pulverization method, for example, a material dispersed in the toner exists nonuniformly on the fracture face, making it difficult to form a uniform surface property among toner particles and easily causes scattering in the transfer process, producing problems such as deteriorated color reproduction of a color image.

Further, particle size reduction has been desired for toners for use in electrostatic image development to achieve higher image quality. Recently, development of polymerization toners has been actively conducted to prepare a size-reduced toner. Preparation of polymerization toners include a method in which resin particles and colorant particles are allowed to be associated through salting-out, flocculation and coalescence to form irregular-form toner, and a method in which a radical-polymerizable monomer and a colorant are mixed and dispersed in an aqueous medium in the form of droplets of a desired size to undergo suspension polymerization.

Application of suspension polymerization forms spherical toner particles exhibiting a uniform surface quality, leading to enhanced homogeneity among toner particles, but the spherical form enhances adhesion onto a latent image carrier, producing problems such as lowered transferability.

JP-A No. 11-194540 (hereinafter, the term, JP-A refers to unexamined Japanese Patent Application Publication) discloses non-spherical particles prepared by treating particulate resin polymerized in an aqueous medium containing a surfactant using a flocculant at a concentration more than the critical flocculation concentration and an organic solvent exhibiting unlimited solubility in water.

The foregoing technique uses di-valent or tri-valent metal salts as a flocculent, resulting in superior uniformity in form and electrostatic charge, leading in turn to images exhibiting superior sharpness, while the presence of the di-valent or tri-valent metal salts raises a Krafft point of a surfactant, forming hardly water-soluble deposits. Even after separating colored particles or a toner from an aqueous medium, such deposits are present in an adhered form to the toner, producing problems such that fine-line reproduction is easily degraded and crushed print (or blocking of characters) easily occurs.

Commonly known nonionic surfactants have been used as an emulsifier of emulsion polymerization and specifically, a nonylphenol type nonionic surfactant has been generally used. The nonyl phenol type nonionic surfactant can be easily applicable in terms of enhanced emulsifying capability. On the other hand, it is difficult to cause its biodegradation due to structure, and it is also difficult to control the particle size in the preparation of toner particles using emulsion polymerization particles, resulting in widened toner particle size distribution and producing problems such as inferior fine-line reproduction and crushed print. Further, polyoxyalkylene alkyl ethers, which are also applicable to emulsion polymerization, exhibit inferior emulsifying capability to the nonylphenol type, so that the amount to be used becomes larger, resulting in remaining in the toner and producing problems such as widened tone article size distribution, inferior fine-line reproduction and crushed print. Accordingly, an emulsifying agent suitable for emulsion polymerization is still being explored.

SUMMARY

In one aspect the present invention is directed to an electrostatic image developing toner containing a compound represented by the following formula (1):

$$R_1O(R_2O)_nH \qquad \text{formula (1)}$$

wherein $R_1$ is an aliphatic hydrocarbon group having 10 to 22 carbon atoms or a distyrene-substituted phenyl group; $R_2$ is an alkylene group having 2 to 6 carbon atoms; and n is an integer of 1 to 15.

In another aspect the invention is directed to an image forming method using the foregoing toner.

BRIEF DESCRIPTION OF THE DRAWING

FIG. 1(*a*) shows a projection of a toner particle having no corner, and FIGS. 1(*b*) and 1(*c*) each shows a projection of a toner particle having corners.

DETAILED DESCRIPTION OF THE EXEMPLARY EMBODIMENTS

Figure 2:
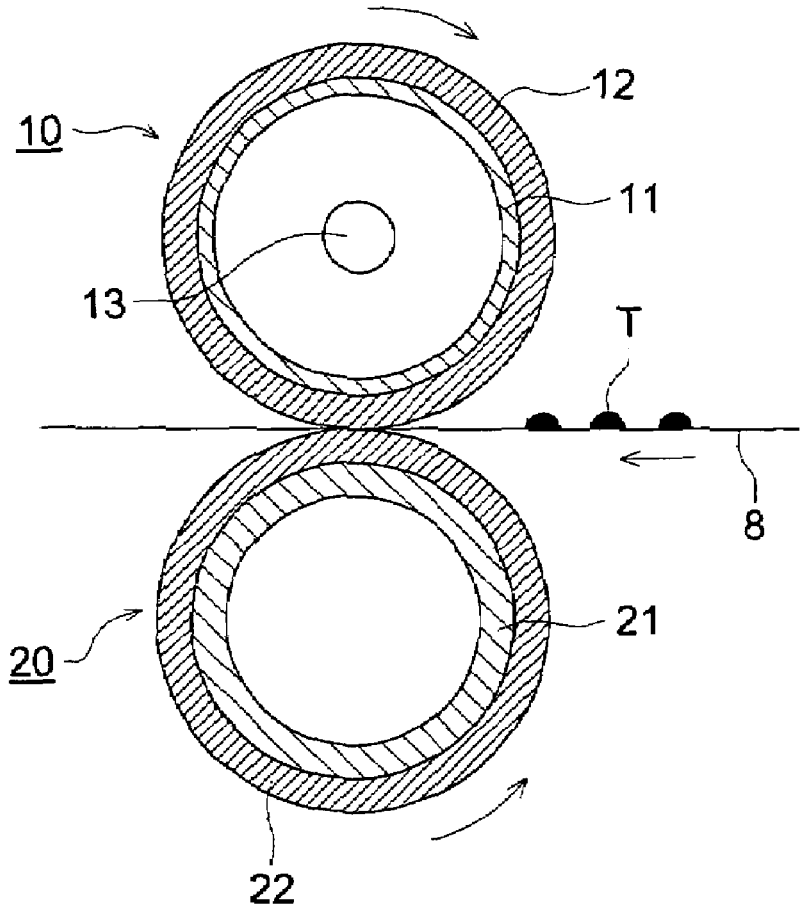
FIG. 2 shows a section of a fixing apparatus.

Means for adjusting the content of a compound represented by the formula (1) contained in the electrostatic image developing toner to 1 to 1000 ppm include:

(a) the amount of surfactants used the time when preparing a latex or dispersing a colorant, (b) adjustment of washing conditions in the preparation of color particles, (c) post-addition, after the preparation of color particles or after preparation of a toner or a developing agent, and (d) adjustment of the concentration of a compound of formula (1) in an aqueous medium (preferably to from 5 to 500 ppm) in the process of allowing resin particles to be coalesced to color particles. Adjustment is feasible by optimal selection of the foregoing. In the foregoing (b), washing water is adjusted in an amount of 40 to 700 times the solid content of color particles.

There will be described preparation of a resin particle dispersion relating to the electrostatic image developing toner and the compound of formula (1) existing in the process of allowing the resin particles to be coalesced to color particles.

In the foregoing formula (1), $R_1$ is an aliphatic hydrocarbon group having 10 to 22 carbon atoms or a distyrene-substituted phenyl group, preferably an aliphatic hydrocarbon group having 10 to 22 carbon atoms, more preferably an aliphatic hydrocarbon group having 10 to 20 carbon atoms, and still more preferably an aliphatic hydrocarbon group having 10 to 18 carbon atoms.

Examples of an aliphatic hydrocarbon group having 10 to 22 carbon atoms, represented by $R_1$ include an alkyl group such as n-decyl, n-undecyl, n-dodecyl, n-tetradecyl, n-pentadecyl, n-hexadecyl, n-heptadecyl, n-octadecyl or n-docosadecyl; an unsaturated aliphatic hydrocarbon group (alkenyl group, alkadienyl group, alkatrienyl group and alkapolyenyl group), such as decenyl, dodecenyl, tridecenyl, pentadecenyl, 5-(3-pentenyl)-3,6,8-decatiene-1-ynyl, 6-(1-pentene-3-ynyl)-2,4,7,9-undecatetraenyl; and acyclic-aliphatic (or alicyclic) hydrocarbon group such as octylcyclohexyl or nonylcyclohexyl. The aliphatic hydrocarbon group may be substituted or unsubstituted.

A distyrene-substituted phenyl group represented by R, may be unsubstituted or substituted by a substituent. The substituent is preferably an aliphatic hydrocarbon group, including, for example, an alkyl group (e.g., methyl, ethyl, propyl, butyl) and alkenyl group (e.g., vinyl, allyl, isopropenyl, pentenyl, octenyl). These alkyl group and alkenyl group may be substituted.

In the formula (1), $R_2$ is an alkylene group having 2 to 6 carbon atoms and preferably an alkylene group having 2 to 3 carbon atoms. Examples of the alkylene group having 2 to 6 carbon atoms, represented by $R_2$ include ethylene group, trimethylene group, tetramethylene group, propylene group and ethylethylene group.

In the formula (1), n is an integer of 1 to 15, preferably 2 to 10, more preferably 2 to 5, and still more preferably 2 to 3.

Determination of Average Molecular Weight

The average molecular weight of a compound of formula (1) can be determined using gel permeation chromatography (also denoted simply as GPC).

GPC Measurement Condition:

Model: HLC-8120 (available from TOSOH CORP.)
Measurement column:
TSK gel SuperH4000 (available from TOSOH CORP.)
TSK gel SuperH3000 (available from TOSOH CORP.)
TSK gel SuperH2000 (available from TOSOH CORP.)
Column temperature: 40° C.
Detector: RI
Measurement solvent: tetrahydrofuran
Flow rate: 0.6 ml/min
Sample concentration: 0.25%, injection amount: 10 μl
Standard sample:
a calibration curve was prepared using at least 8 kinds of polyoxyethylene glycol differing in molecular weight (TSK STANDARD POLYETHYLENE OXIDE, available from TOSOH CORP.).

Data processing apparatus: SC-8020 (TOSOH CORP.)

Proportion of a compound having "n" of 3 to 6:

Of the whole compound represented by formula (1) contained in the toner, the compounds having n of 3 to 6 preferably account for 50% to 90%, and more preferably 70% to 80% by weight. In the compounds of formula (1), even if $R_1$ is a single group, the addition number of moles (n) usually has a distribution, that is, n is not a single value but falls within plural values. Therefore, the difference in addition number of moles (n) causes difference in emulsifying capability. To achieve enhanced emulsification, it is preferred that compounds having n of falling within 3 to 6 account for 50% to 90% by weight of the compounds of formula (1) contained in the toner. Of the whole compound of formula (1), the proportion of a compound of n of 3 to 6 can be represented by that of an area value accounted for by the compounds, of the total area of the compound of formula (1) in the chromatography curve obtained by the GPC measurement. Thus, the proportion of the compound of n of 3 to 6 can be calculated by a ratio of an area of the compound of n of 3 to 6 to that of the whole compound represented by formula (1), based on the chromatography curve.

HLB Value of Compound of Formula (1):

The compound of formula (1) preferably exhibits a HLB value of 15 to 20, more preferably 17 to 19, and still more preferably 17 to 18 in terms of enhancing emulsifying ability. The HLB (Hydrophile-Lipophile Balance) refers to a value obtained by summing up values exhibiting organic and inorganic properties (as referred, for example, to Oda & Teramura "Kaimenkasseizai no Gosei to Ohyo" (Synthesis and Application of Surfactant, page 501, published by Makishoten).

Cloud Point of Compound of Formula (1)

The compound of formula (1) preferably exhibits a cloud point of at least 60° C., more preferably at least 80° C., and still more preferably 85 to 110° C. in terms of enhancing emulsifying ability and dispersibility. The cloud point can be determined by methods known in the art. For example, when an aqueous solution of a compound of formula (1) is prepared and gradually heated, the cloud point can be determined as a temperature causing solid-liquid separation by visual observation or from a change of transmittance using a spectrometer. To achieve precise determination thereof, there can be applied a method of determining cloud points of commonly known surfactants by an optical technique.

Specific examples of the compound of formula (1) are shown below but the invention is not limited to these:

$C_{12}H_{25}O(CH_2CH_2O)_4H$ compound (1):

$C_{12}H_{25}O(CH_2CH_2O)_4H$ compound (2):

$C_{18}H_{37}O(CH_2CH_2O)_3H$ compound (3):

$C_{12}H_{25}O(CH_2CH_2O)_5H$. compound (4):

Further, examples of a compound of formula (1) having $R_1$ of a distyrene-substituted phenyl group include Neugen type EA-167 and EA-177 (available from DAIICH SEIYAKU CO., LTD.).

Compounds of formula (1), which are an alkylene oxide addition type nonionic surfactant, can be prepared by methods described in JP-A Nos. 10-130690, 2002-53895 and 2002-53897 or by employing a commonly known alkylene oxide addition reaction. Specifically, the preparation can be achieved by allowing ethylene oxide, propylene oxide, butylenes oxide or the like to be added to an alcohol under a reaction catalyst at a temperature of 70 to 200° C. through a specific addition system. For example, to a higher alcohol having 10 to 22 carbon atoms, an alkali (e.g., KOH) or acid (e.g., $BF_3$) is added as a catalyst and a mixture of ethylene oxide and propylene oxide is allowed to be randomly added under a nitrogen atmosphere, followed by addition of ethylene oxide and further followed by addition of propylene oxide to perform the preparation thereof.

At compound selected from a compound containing a calcined magnesium oxide (as described in JP-A No. 1-164437), calcined hydrotalcite (as described in JP-A No. 2-71841) a perchlorate (U.S. Pat. No. 4,112,231), a perhalogenic acid (or its salt), sulfuric acid (or sulfate), nitric acid (or nitrate), and a di- or tri-valent metal alcoholate is preferably used as a catalyst in the reaction so that the compound(s) of "n" of 3 to 6 accounts for 20% to 80% of the whole of the compounds of formula (1) or a so-called molecular weight distribution is made narrow.

The content of the surfactant of formula (1) in the electrostatic image developing toner preferably is 1 to 1000 ppm, more preferably 5 to 500 ppm, and still more preferably 7 to 100 ppm to maintain a charge-holding function in a suitable state, to inhibit fogging under high temperature and high humidity and to enhance transferability, and further to inhibit an increase in electrostatic charge under low temperature and low humidity and stabilize the developing amount. The content of the surfactant is represented based on the weight of the toner and the toner is one in a state of being used for image formation. When a toner contains an external additive, for example, the content is represented based on the weight of the toner containing the external additive. The electrostatic property of the electrostatic image developing toner can be uniformly and stably maintained by incorporating the surfactant in the foregoing amount without being influenced by the ambient environment.

The content of the surfactant of formula (1) of the electrostatic image developing toner can be determined by absorptiometry (or colorimetry) in the following manner. Thus, 1 g of a toner is dispersed in 50 ml of deionized water and filtered, and after the compound of formula (1) is extracted into a water phase, 10 ml of extraction liquid is taken out and mixed with a cobalt ammonium thiocyanate solution (which is obtained by dissolving 112.4 g of ammonium thiocyanate and 59.4 g of cobalt nitrate in water to make 250 ml), and 8 g of sodium chloride with shaking for 1 min. Subsequently, 10 ml of benzene is added thereto and shaken for 5 min to separate benzene. The absorbance at a wavelength of 320 nm is measured and the content within the toner is determined using a calibration curve which was previously prepared within a concentration range of not more than 90 ppm.

In the process of allowing resin particles prepared in an aqueous medium to be salted out, coagulated and coalesced in a dispersion containing the resin particles prepared in aqueous medium, metal salts are preferably used as a flocculant and di- or tri-valent metal salts are more preferred as a flocculant. This is due to the fact that di- or tri-valent metal salts exhibit a critical flocculation concentration (flocculation value or flocculating point) less than that of mono-valent metal salts.

Metal salts used as a flocculant or a flocculation terminator, as described hereinafter, include mono-valent metal salts, for example, salts of alkali metals such as sodium, potassium and lithium; di-valent metal salts, for example, salts of alkaline earth metals such as calcium and magnesium and di-valent metal salts such as manganese and copper; and tri-valent metal salts, such as iron and aluminum. Specific examples thereof include mono-valent metal salts such as sodium chloride, potassium chloride and lithium chloride; di-valent metal salts such as magnesium chloride, calcium chloride, calcium nitrate, zinc chloride, copper sulfate, magnesium sulfate and manganese sulfate; tri-valent metal salts such as aluminum chloride and iron chloride. These are optimally chosen according to the object.

The foregoing critical flocculation concentration is a measure relating to stability of dispersed material in an aqueous dispersion, indicating a concentration at which flocculation occurs when adding a flocculant. The critical flocculation concentration varies depending on the flocculant itself and the dispersing agent used therein, which are described, for example, in S. Okamura et al., "Kobunshi Kagaku" 17, 601 (1960) and therefrom, values can be found. Alternatively, a desired salt is added to a particle dispersing solution with varying the concentration to measure the ζ-electric potential of the particle dispersing solution and the salt concentration at which the ζ-electric potential starts to vary can be defined as the critical flocculation concentration.

A particulate polymer dispersion is treated using the metal salt described above so as to form a concentration greater than the critical flocculation concentration. In this regard, directly adding a metal salt or addition in the form of an aqueous solution is appropriately chosen according to the object. When added in the form of an aqueous solution, the concentration of the added metal salt needs to be greater that the critical flocculation concentration, based on the whole volume of the particulate polymer dispersion and the aqueous metal salt solution. The concentration of a metal salt used as a flocculant may be greater than the critical flocculation concentration, preferably by a factor of at least 1.2 and more preferably at least 1.5 times greater than the critical flocculation concentration.

When a flocculant is added to a dispersion of composite resin particles (which are referred to as multi-layer particles or particles including other constituents such as an additive) or a dispersion of color particles, the temperature of the dispersion is preferably lower than the glass transition temperature (Tg) of the composite resin particles, more preferably 5 to 55° C. and still more preferably 10 to 45° C. A dispersion temperature higher than the glass transition temperature of the composite resin particles when adding a flocculant makes it difficult to control the particle size, easily forming enormous particles.

In the process of salting-out, flocculation and coalescence, when the temperature of a dispersion of composite resin particles and color particles is lower than the glass transition temperature (Tg) of the composite resin particles, it is preferred that a flocculant is added to the dispersion with stirring and then, heating the dispersion is promptly started to a temperature of the glass transition temperature of the composite resin particles (Tg) or a higher temperature.

When resin particles and-a colorant are subjected to salting-out, flocculation and coalescence in an aqueous medium to obtain color particles (which are, in this application, also called toner particles), the toner particles are separated from the aqueous medium preferably at a temperature higher than the Krafft point of the surfactant present in the aqueous medium, and more preferably at a temperature within the range of the Krafft point to the Krafft point plus 20° C. The Krafft point refers to the temperature at which an aqueous solution containing a surfactant starts to become milky-white. The Krafft point can be determined in the following manner. To an aqueous medium used in the stage of salting-out, flocculation and coalescence, that is, an aqueous surfactant solution, a surfactant is added in an amount to be used in actual production to prepare a solution and the solution is further aged at 1° C. for 5 days. Subsequently, while stirring, the solution is gradually heated until it becomes transparent. The temperature at which the solution starts to become transparent is defined as the Krafft point.

The electrostatic image developing toner preferably contains the foregoing metal element (for example, in the form of a metal or metal ion) in an amount of 250 to 20000 ppm, and more preferably 800 to 5000 ppm of the toner in terms of inhibiting excessive electrostatic charges and providing a uniform electrostatic property to the toner particles, specifically to maintain stable electrostatic property. In this invention, the total amount of a divalent (or trivalent) metal element used as a flocculant and a monovalent metal element added as a flocculation terminator is preferably 350 to 35000 ppm. The content of metal ions remaining in the toner can be determined by measuring the fluorescent X-ray intensity emitted from metal species of the metal salt used as a flocculant (for example, calcium assigned to calcium chloride), using a fluorescent X-ray spectrometer, System 3270 Type (available from Rigaku Denki Kogyo Co., Ltd.). Specifically, plural toners which are known with respect to contents of flocculant metal salts are prepared and of each of them, 5 g is pelletized and the relationship (or calibration curve) between the content of flocculant metal salts (in ppm by weight) and the fluorescent X-ray intensity (peak intensity) emitted from metal species of a metal salt used as a flocculant is determined. Subsequently, a toner (sample) which is to be determined for the flocculant metal salt content is similarly pelletized and the intensity of fluorescent X-rays emitted from metal species of a flocculant metal salt is measured to determine the content, that is, the residual content of metal ions of the toner.

Next, there will be described preparation of the electrostatic image developing toner. The toner can be prepared in such a manner that composite resin particles are formed in the absence of a colorant and a dispersion of color particles is added to a dispersion of the formed composite resin particles, then, the composite resin particles and the color particles are allowed to be salted out, coagulated and coalesced. Formation of the composite resin particles in the absence of a colorant results in the polymerization reaction of the composite resin particles to not be inhibited by the colorant. Accordingly, staining of the fixing apparatus and image staining, which are caused by accumulation of a toner, can be reduced without vitiating superior off-set resistance. The polymerization reaction to obtain composite resin particles is completely undergone so that no monomer or no oligomer remains in the toner particles and production of foul odor is reduced in the thermal fixing stage when using the toner during the imaging process. Further, surface characteristics of the thus obtained toner particles are uniform, leading to a narrow distribution of electrostatic charges, whereby formation of images exhibiting superior sharpness can be achieved over a long period of time.

The foregoing composite resin particles constituting the toner refer to resin particles having a multilayer structure in which nucleus particles formed of a resin are covered with a resin which is different in molecular weight or composition from the resin forming the nucleus particles.

The central portion (nucleus) of the composite resin particles refers to a nucleus particle constituting the composite resin particle. The outer layer (shell) refers to the outermost layer of one or plural covering layers constituting the composite resin particles. Furthermore, the interlayer of the composite resin particles refers to a covering layer formed between the center portion (nucleus) and the outer layer.

The molecular weight distribution of resin(s) forming the composite resin particles is not monodisperse and the composite resin particles, each has a gradient of molecular weight from the center (nucleus) to the outer layer (shell).

A multi-step polymerization process is preferably employed to obtain the composite resin particles in terms of control of molecular weight distribution, that is, to achieve sufficient fixing strength and off-set resistance. In this invention, the multi-stage polymerization process to obtain the composite resin particles refers to a process in which, in the presence of resin particles (n) obtained by polymerization (designated as the n-th step) of monomer (n), monomer (n+1) is polymerized [designated as the (n+1)-th step] to form covering-layer (n+1) comprised of a polymer formed of monomer (n+1) which is a resin differing in dispersion and/or composition from the resin constituting the resin particles (n). Wherein, when resin particles (n) are each nucleus particles (that is, n=1), the process is a two-step polymerization; and when the resin particles (n) are composite resin particles ($n \geqq 2$), it is a multi-step polymerization of three- or more steps or more.

Plural resins differing in composition and/or molecular weight exist within the composite resin particles obtained by the multi-step polymerization process. Accordingly, a toner which is obtained by allowing the composite resin particles and color particles to be salted out, coagulated and coalesced, exhibits little fluctuation in composition, molecular weight and surface characteristics. Using such a toner which is homogeneous in composition, molecular weight and surface characteristic among particles, enhancement of off-set resistance and prevention of winding can be achieved in the imaging process including a fixing step of a contact heating system, leading to formation of images exhibiting optimal glossiness.

Specific examples of a preparation method of an electrostatic image developing toner include a process comprising (1) the multi-step polymerization step (I) to obtain composite resin particles which are prepared so that a mold-releasing agent and/or crystalline polyester is contained in the region (central portion or interlayer) other than the outermost layer; (2) salting-out, flocculation and coalescence step (II) of allowing the composite resin particles to be salted out, coagulated and coalesced to obtain toner particles; (3) the filtering and washing step of filtering off toner particles from a toner particle dispersion and removing a surfactant and the like from the toner particles; (4) the drying step of drying the washed toner particles; and (5) the step of adding an external additive to the dried toner particles.

Next, the respective steps will be described.

Multi-Step Polymerization (I)

The multi-step polymerization step (I) is a stage in which on the surface of resin particle (n), covering layer (n+1) comprising a polymer formed of monomer (n+1) is formed to prepare composite resin particles. It is preferred to adopt a multi-step polymerization comprised of three or more steps from the viewpoint of manufacturing stability and fracturing resistance of the toner.

There will be described the two-step polymerization process and three-step polymerization process, as representative examples of multi-step polymerization.

Two-Step Polymerization

The two-step polymerization process is a process of preparing composite resin particles which are each comprised of a central portion (nucleus) formed of a high molecular weight resin, containing a mold-releasing agent, and an outer layer (shell) formed of a low molecular weight resin. Thus, the composite resin particles obtained by the two-step polymerization process are each comprised of a nucleus and a single covering layer. Specifically, a monomer solution obtained by dissolving a mold-releasing agent in a monomer is dispersed in an aqueous medium (e.g., aqueous surfactant solution) in the form of oil drops and this system is subjected to polymerization (1st polymerization step) to prepare a dispersion of resin particles (H) of high molecular weight, containing a mold-releasing agent. Subsequently, to the dispersion of resin particles (H), a polymerization initiator and monomer (L) to obtain a low molecular weight resin are added and allowed to be polymerized (2nd polymerization step) in the presence of resin particles (H) to form covering layer (L) comprised of a low molecular weight resin on the resin particle (H) surface.

Three-Step Polymerization

The three-step polymerization process is a process of preparing composite resin particles which are comprised of a central portion (nucleus) formed of a high molecular weight resin, an interlayer containing a mold-releasing agent and an outer layer (shell) formed of a low molecular weight resin. Thus the composite resin particles prepared by the three-step polymerization process are composed of a nucleus, and two covering layers. Specifically, a dispersion of resin particles (H) obtained according to a conventional polymerization process (1st polymerization step) is added to an aqueous medium (e.g., aqueous surfactant solution), a monomer solution obtained by dissolving a mold-releasing agent in monomer (M) is dispersed in the aqueous medium in the form of oil drops and this system is subjected to polymerization (2nd polymerization step) to prepare a dispersion of composite resin particles [high molecular weight resin (H)-intermediate molecular weight resin (M)] having covering layer (M) (interlayer) comprised of resin [polymer of monomer (M)] on the surface of the resin particle (H) (nucleus particle). Subsequently, to the obtained composite resin particle dispersion, a polymerization initiator and monomer (L) to obtain a low molecular weight resin are added and allowed to be polymerized (3rd polymerization step) in the presence of the resin particles to form covering layer (L) comprised of a low molecular weight resin [polymer of monomer (L)] on the resin particle surface.

In the foregoing three-step polymerization process, when forming the covering layer (M) on the resin particle (H) surface, a dispersion of the resin particles (H) is added to an aqueous medium (e.g., an aqueous surfactant solution) and a monomer solution obtained by dissolving a mold-releasing agent in monomer (M) is dispersed in the aqueous medium in the form of oil drops, then, the system is subjected to a polymerization process (2nd polymerization step), and thereby, the minute mold-releasing agent can be dispersed homogeneously.

With respect to the foregoing step of adding a dispersion of resin particles (H) and the step of dispersing the monomer solution in the form of oil droplets, either of the steps may be carried out in advance or both of them may be simultaneously carried out, as described below.

Thus, there are included embodiment (a) in which resin particles forming the central portion (nucleus) are added to an aqueous surfactant solution and a monomer composition containing mold-releasing agent/crystalline polyester is dispersed in the aqueous dispersion, after which this system is subjected to the polymerization process to form the interlayer constituting the composite resin particles; embodiment (b) in which a monomer composition containing mold-releasing agent/crystalline polyester is dispersed in an aqueous surfactant solution and resin particles forming the central portion (nucleus) of the composite resin particles are added to the aqueous surfactant solution, concurrently, this system is subjected to the polymerization process to form the interlayer constituting the composite resin particles; embodiment (c) in which resin particles forming the central portion (nucleus) of the composite resin particles are added to an aqueous surfactant solution and concurrently, a monomer composition containing a mold-releasing agent/crystalline polyester is dispersed in the aqueous solution, then, this system is subjected to the polymerization process to form the interlayer constituting the composite resin particles.

Resin particles (nuclei) containing a mold-releasing agent or a covering layer (interlayer) can be formed in such a manner that a mold-releasing agent is dissolved in a monomer and the obtained monomer solution is dispersed in the form of oil droplets dispersed in an aqueous medium, then, this system is further subjected to polymerization process to obtain latex particles. Herein, the aqueous medium refers to a medium comprised of 50 to 100 wt % water and of a 0 to 50 wt % water-soluble organic solvent. Examples of a water-soluble organic solvent include methanol, ethanol, isopropanol, butanol, acetone, methyl ethyl ketone, and tetrahydrofuran and alcohol type organic solvents not dissolving the obtained resin are preferred.

Examples of a polymerization process suitable for the foregoing formation of resin particles containing a mold-releasing agent or a covering layer include a process in which a surfactant is dissolved in an aqueous medium at a concentration less than the critical micelle concentration and a monomer solution obtained by dissolving a mold-releasing agent is dispersed in the form of oil droplets dispersed in the aqueous medium, employing mechanical energy, then, a water-soluble polymerization initiator is added to the obtained dispersion to allow radical polymerization to occur within the oil droplets (hereinafter, also called a mini-emulsion method). Further, instead of adding a water-soluble polymerization initiator, an oil-soluble polymerization initiator may be added to the monomer solution, concurrently with the addition of the water-soluble polymerization initiator.

In the mini-emulsion method-differing from the conventional emulsion polymerization method, a mold-releasing agent dissolved in an oil phase does not leave the oil phase and a sufficient amount of the mold-releasing agent can be introduced into the formed resin particles containing a mold-releasing agent or a covering layer. Dispersing machines to perform the foregoing oil droplet dispersion employing mechanical energy are not specifically limited, including, for example, a stirring apparatus provided with a high-speed rotor, CLEAR MIX (product of M Techntique Co., Ltd.), an ultrasonic disperser, a mechanical type homogenizer, Manton-Gaulin homogenizer and a pressure type homogenizer. The dispersing particle size is 10 to 1000 nm, preferably 50 to 1000 nm, and more preferably 30 to 300 nm.

Commonly known methods such as the emulsion polymerization method, the suspension polymerization method and the seed polymerization method are also adoptable as a polymerization process for forming resin particles containing a mold-releasing agent or a covering layer. These polymerization methods are also adaptable to obtain resin particles (nucleus) or a covering layer constituting composite resin particles and contain neither mold-releasing agent nor crystalline polyester.

The sizes of composite resin particles obtained in the foregoing polymerization process (I), which can be determined using a electrophoresis light-scattering photometer (ELS-800, product of Otsuka Denshi Co., Ltd.), are within the range of 10 to 1000 nm.

The glass transition temperature (Tg) of composite resin particles is preferably within the range of 52 to 64° C., and the softening point of the composite resin particles is preferably within the range of 95 to 140° C.

Salting Out, Flocculation and Coalescence step (II)

The salting out, flocculation and coalescence step (II) is a stage in which composite resin particles obtained in the foregoing multistep polymerization step and color particles are allowed to be salted out, coagulated and coalesced to form irregular-form (or non-spherical) toner particles (in which salting-out and coalescence simultaneously occur).

In the salting-out, flocculation and coalescence step (II), particles of internal additives such as a charge control agent (microparticles having a number-average primary particle size of 10 to 1000 nm) may be salted-out, coagulated and coalesced together with composite resin particles and color particles.

Color particles may be surface-modified, in which commonly known surface-modifiers are usable. The color particles, which are in the form of solid particles dispersed in an aqueous medium, are salted out, coagulated and coalesced. Aqueous mediums in which the color particles are to be dispersed, include, for example, an aqueous solution containing surfactants at a concentration more than a critical micelle concentration (CMC). There are usable surfactants which are the same as used in the foregoing multi-step polymerization step (I). Dispersing machines usable to disperse color particles are not specifically limited and include, for example, a stirring apparatus provided with a high-speed rotor, CLEAR MIX (product of M Technique Co., Ltd.), a ultrasonic disperser, a mechanical type homogenizer, a compression disperser such as Manton-Gaulin homogenizer and a pressure type homogenizer, Gettsman mill, and diamond fine mill.

To allow composite resin particles and color particles to be salted out, coagulated and coalesced, a flocculant is added at a concentration greater than the critical flocculation concentration to a dispersion containing the composite resin particles and color particles, and further it is preferred to heat the dispersion at a temperature higher than the glass transition temperature (Tg) of the composite resin. It is more preferred to add a flocculation terminator at the time when the composite resin particles reach the intended particle size. Monovalent metal salts are usable as such a flocculation terminator, specifically, sodium chloride is preferably used. The temperature to achieve salting-out, flocculation and coalescence is preferably within the range of from (Tg+10° C.) to (Tg+50° C.), and more preferably from (Tg+15° C.) to (Tg+40 ° C). An organic solvent infinitely soluble in water may be added to effectively achieve coalescence. Flocculants used in salting out, flocculation and coalescence include, for example, alkali metal salts described above and alkaline earth metal salts.

Salting out and flocculation will be described hereinafter. The expression, achieving salting out, flocculation and coalescence means salting out (flocculation of particles) and coalescence being concurrently caused, or action allowing salting out and coalescence to be concurrently caused. To allow salting out and coalescence to concurrently result, it is preferred to coagulate particles (composite resin particles, color particles) at a temperature higher than a glass transition temperature (Tg) of a resin forming the composite resin particles.

It is preferred to prepare the electrostatic image developing toner in the manner that composite resin particles are formed in the absence of a colorant and a dispersion of color particles is added to a dispersion of the composite resin particles to cause the composite particles and the color particles to be salted out, coagulated and coalesced. Inhibition of the polymerization reaction to obtain the composite resin can be avoided by preparation of the composite resin particles in the absence of a colorant. As a result, staining of the fixing apparatus and image staining, which are caused by accumulation of a toner, can be reduced without vitiating superior off-set resistance. The polymerization reaction to obtain composite resin particles is completely undergone so that no monomer or no oligomer remains in toner particles and, during the imaging process, production of foul odors is reduced in the thermal fixing stage using the toner. Further, surface characteristics of the thus obtained toner particles are uniform, leading to a narrow distribution of electrostatic charge, whereby formation of images exhibiting superior sharpness can be achieved over a long period of time. Using such a toner which is homogeneous in composition, molecular weight and surface characteristic among particles, enhancement of off-set resistance and prevention of winding can be achieved in the imaging process including a fixing step of a contact heating system, leading to formation of images exhibiting an optimal glossiness.

Next, mold-releasing agents used in the toner will be described. A mold-releasing agent is usually contained in amount of 1 to 30%, preferably 2 to 20%, and more preferably 3 to 15% by weight based on the toner.

There may be added, as a mold-releasing agent, a low molecular weight polypropylene (having a number-average molecular weight of 1500 to 9000) or a low molecular weight polyethylene, and a preferred mold-releasing agent is an ester compound represented by the following formula:

$$R_1—(OCO—R_2)_n$$

wherein n is an integer of 1 to 4 (preferably 2 to 4, more preferably 3 or 4 and still more preferably 4); $R_1$ and $R_2$ are each a hydrocarbon group, which may be substituted. $R_1$ has 1 to 40 carbon atoms (preferably 1 to 20, and more preferably 2 to 5 carbon atoms); $R_2$ has 1 to 40 carbon atoms (preferably 16 to 30, and more preferably 18 to 26 carbon atoms).

Specific examples of the ester compound represented by the foregoing formula are shown below but are by no means limited to these.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3—(CH_2)_{20}—COO—(CH_2)_2—CH(CH_3)—CH_2—O—CO—(CH_2)_{20}—CH_3$

7) $CH_3—(CH_2)_{22}—COO—(CH_2)_2—CH(CH_3)—CH_2—O—CO—(CH_2)_{22}—CH_3$

8) $CH_3—(CH_2)_{22}—COO—CH_2—C(CH_3)_2—CH_2—O—CO—(CH_2)_{22}—CH_3$

9) $CH_3—(CH_2)_{26}—COO—CH_2—C(CH_3)_2—CH_2—O—CO—(CH_2)_{26}—CH_3$

10) $CH_2—O—CO—(CH_2)_{26}—CH_3$
$CH—O—CO—(CH_2)_{26}—CH_3$
$CH_2—O—CO—(CH_2)_{26}—CH_3$

11) $CH_2—O—CO—(CH_2)_{22}—CH_3$
$CH—O—CO—(CH_2)_{22}—CH_3$
$CH_2—O—CO—(CH_2)_{22}—CH_3$

12) $CH_2—OH$
$CH—O—CO—(CH_2)_{26}—CH_3$
$CH_2—O—CO—(CH_2)_{26}—CH_3$

13) $CH_2—OH$
$CH—O—CO—(CH_2)_{22}—CH_3$
$CH_2—O—CO—(CH_2)_{22}—CH_3$

14) $CH_2—OH$
$CH—OH$
$CH_2—O—CO—(CH_2)_{26}—CH_3$

-continued

15)

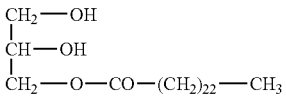

16)

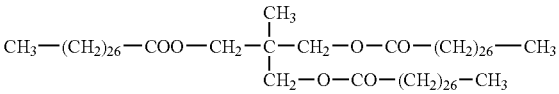

17)

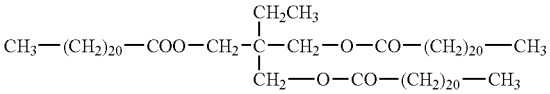

18)

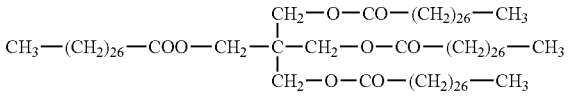

19)

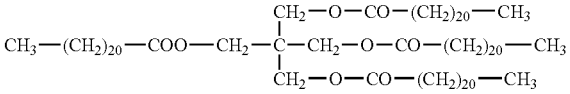

20)

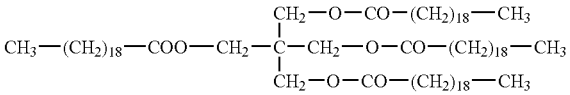

21)

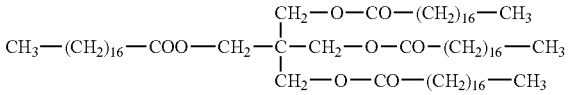

The foregoing mold-releasing agent, as a fixing modifier is added preferably in an amount of 1 to 30%, more preferably 2 to 20%, and still more preferably 3 to 15% by weight, based on the whole electrostatic image developing toner.

Next, resin components forming the electrostatic image developing toner (hereinafter, also denoted simply as toner) will be described with respect to molecular weight, its range and peak molecular weight. In the molecular weight distribution of a resin component of the toner, the peak or shoulder are preferably at 100,000 to 1,000,000 and 1,000 to 50,000, and more preferably at 100,000 to 1,000,000, 25,000 to 150,000, and 1,000 to 50,000. The resin is preferably comprised of a high molecular weigh component having a peak or a shoulder of 100,000 to 1,000,000 and a low molecular weight component having a peak or shoulder at 1,000 to 5,000. Further, the use of a resin having an intermediate molecular weight component having a peak at 15,000 to 1000,000 is more preferred.

Molecular weight can be determined employing GPC (Gel Permeation Chromatography) using THF (tetrahydrofuran) as a column solvent. Specifically, to 1 mg of a measurement sample, 1 ml of THF is added and stirred using a magnetic stirrer under room temperature until sufficiently dissolved. Subsequently, after filtering through a membrane filter having a pore size of 0.45 to 0.50 μm, sample solution is injected into the GPC. Measurement is conducted under the condition that after being stabilized at 40° C., THF flows at a rate of 1 ml per min. and 100 μl of a sample having a concentration of 1 mg/ml is injected to conduct the measurement. The combined use of commercially available polystyrene gel columns is preferred. Examples thereof include combinations of Shodex GPC KF-801, 802, 803, 804, 805, 806, and 807 (product of Showa Denko Co., Ltd.); the combination of TSK gel G1000H, G2000H, G3000H, G4000H, G5000H, G6000H, G7000H and TSK guard column (a product of TOSOH CORP.). A refractive index detector (IR detector) or a UV detector is preferred as the detector used. In the molecular weight measurement of a sample, the molecular weight distribution of the sample is calculated using a calibration curve prepared by using monodisperse polystyrene standard particles. About 10 points are preferably used as polystyrene for the calibration curve.

Next, there will be described the filtration and washing step relating to the preparation of the electrostatic image developing toner. The filtration and washing step comprises filtration to filter off toner particles from the toner particle dispersion, obtained in the foregoing step, and washing to remove adherents such as surfactants or flocculants from the filtrated toner particles (aggregates in a cake form). Filtration methods are not specifically limited, including centrifugal separation, reduced-pressure filtration using a Nutsche funnel and a filtration method using a filter press.

The drying step is a stage of drying the washed toner particles. Drying machines usable in this step include, for example, a spray drier, a vacuum freeze drier and a reduced-pressure drier; and a standing rack drier, a moving rack drier, a fluidized-bed drier, a rotary drier and a stirring drier are preferably used. Dried toner particles preferably have a moisture content of not more than 5% and more preferably not more than 2% by weight. When dried particles are aggregated with each other by attraction force between particles, the aggregates may be disintegrated. Mechanical disintegrating apparatuses such as a jet-mill, a Henschel mixer, a coffee mill or a food processor can be employed as a disintegrating apparatus.

Next, polymerizable monomers will be described.

(1) Hydrophobic Monomer:

Hydrophobic monomers constituting monomer components are not specifically limited and commonly known hydrophobic monomers are usable. One or more monomers can be used in combination to meet required characteristics.

Specifically, there are usable a monovinylaromatic type monomer, a (metha)acrylic acid ester type monomer, a viny ester type monomer, a vinyl ether type monomer, a monoolefin type monomer, a diolefin type monomer and a halogenated olefin type monomer. Examples of a vinyl aromatic type monomer include styrene monomers such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene and 3,4-dichlorostyrene, and their derivatives. Examples of acryl type monomers include acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate and diethylaminoethyl methacrylate. Examples of a vinyl ester type monomer include vinyl acetate, vinyl propionate, and vinyl benzoate. Examples of a vinyl ether type monomer include vinyl methyl ether, vinyl ethyl ether, vinyl sobutyl ether and vinyl phenyl ether. Example of a monoolefin type monomer include ethylene, propylene, isobutylene, 1-butene, 1-pentene and 4-methyl-1-pentene. Example of diolefin type monomer include butadiene, isoprene and chloroprene.

(2) Cross-linkable Monomer:

A cross-linkable monomer may be added to improve characteristics of resin particles. Examples of a cross-linkable monomer include ones containing at least two unsaturated bonds, such as divinylbenzene, divinylnaphthalene, divinylether, diethylene glycol methacrylate, ethylene glycol dimethacrylate, polyethylene glycol dimethacrylate and diacryl phthalate.

(3) Acetic Polar Group-containing Monomer:

Monomers containing an acetic polar group include (a) a α,β-ethylenically unsaturated compound containing a carboxyl group (—COOH), and (b) a α,β-ethylenically unsaturated compound containing a sulfonic acid group (—$SO_3H$). Examples of (a) a α,β-ethylenically unsaturated compound containing a carboxyl group (—COOH) include acrylic acid, methacrylic acid, fumaric acid, methacrylic acid, itaconic acid, cinnamic acid, monobutyl maleate, monooctyl maleate and their metal salts, such as Na or Zn. Examples of (b) a α,β-ethylenically unsaturated compound containing a sulfonic acid group (—$SO_3H$) include a sulfonated styrene and its Na salt, allylsulfosuccinic acid, octyl allylsulfosuccinate and their Na salt.

Next, there will be described polymerization initiators used for polymerization of polymerizable monomer (also simply called initiators). Any water-soluble polymerization initiator is optimally usable. Examples thereof include persulfates (e.g., potassium persulfate, ammonium persulfate), azo compounds [e.g., 4,4'-azobis-cyanovaleric acid and its salt, 2,2'-azobis(2-amidinopropane)-salt], and peroxide compounds such as hydrogen peroxide and benzoyl peroxide. The foregoing polymerization initiators may be combined with a reducing agent and used as a redox initiator. The use of a redox initiator results in enhanced polymerization activity and lowering of the polymerization temperature, thereby shortening the polymerization time. The polymerization temperature can be chosen at any temperature higher than the lowest temperature forming a radical of an initiator, for example, within the range of 50 to 80° C. The use of polymerization initiators initiating at ordinary temperature, for example, a combination of hydrogen peroxide and a reducing agent (e.g., ascorbic acid) enables polymerization at room temperature or a temperature close thereto.

Commonly known chain transfer agents are usable to control the molecular weight of resin particles formed by polymerization of the foregoing polymerizable monomers. Chain transfer agents are not specifically limited and mercapto group containing compounds are preferably used, the use of which leads to a toner having a narrow molecular weight distribution, resulting to superior storage stability, enhanced fixing power and improved off-set resistance. Mercapto group containing compounds such as octylmercaptan, dodecylmercaptan and tert-dodecylmercaptan, for example, are usable. Preferred examples thereof include ethyl thioglycolate, propyl thioglycolate, butyl thioglycolate, t-butyl thioglycolate, 2-ethylhexyl thioglycolate, octyl thioglycolate, decyl thioglycolate, dodecyl thioglycolate, ethylene glycol thioglycolate, neopentylglycol thioglycolate, and pentaerythritol thioglycolate. Specifically, n-octyl-3-mercaptopropionic acid ester is preferred in terms of inhibiting odors produced in thermal fixation of toners.

To enhance charge uniformity of toners, it is preferred that colorants relating to the electrostatic image developing toner are subjected to salting-out, flocculation and coalescence together with resin particles to be included in toner particles. Colorants (color particles which are subjected, together with composite resin particles, to salting-out, flocculation and coalescence) constituting the toner include various inorganic pigment, organic pigments and dyes. Commonly known inorganic pigments are usable and specific examples of inorganic pigments are as follows.

Black pigments include, for example, carbon black such as furnace black, channel black, acetylene black, thermal black and lamp black and magnetic powders such as magnetite and ferrite. These inorganic pigments can be used singly or in combinations according to intention. The pigment is added in an amount of 2 to 20% and preferably 3 to 15% by weight. In cases where it is used as a magnetic toner, the foregoing magnetite may be incorporated. To provide given magnetic characteristics, magnetite is contained preferably in an amount of 20 to 120% by weight, based on toner.

There are also usable commonly known organic pigments and dyes. Specific examples of organic pigments are as follows.

Magenta and red pigments include C.I. Pigment Red 2, C.I. Pigment Red 3, C.I. Pigment Red 5, C.I. Pigment Red 16, C.I. Pigment Red 48, C.I. Pigment Red 53, C.I. Pigment Red 57, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Orange or yellow pigments include C.I. Pigment Orange 31, C.I. Pigment Orange43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, C.I. Pigment Yellow 138, C.I. Pigment Yellow 180, C.I. Pigment Yellow 185, C.I. Pigment Yellow 155, and C.I. Pigment Yellow 156.

Green or cyan pigments include C.I. Pigment Blue 15, C.I. Pigment Blue 15:2, C.I. Pigment Blue 15:3, C.I. Pigment Blue 16, C.I. Pigment Blue 60 and C.I. Pigment Green 7.

Further, usable dyes include, for example, C.I. Solvent Red 1, the said 49, the said 52, the said 58, the said 63, the said 111, the said 122; C.I. Solvent Yellow 19, the said 44, the said 77, the said 79, the said 81, the said 82, the said 93, the said 98, the said 103, the said 104, the said 112, the said 162; and C.I. Solvent Blue 25, the said 36, the said 60, the said 70, the said 93 and the said 95. A mixture of the foregoing dyes is also usable.

The foregoing organic pigments and dyes are usable alone or in combinations of a plurality of them. The pigments are usually incorporated in an amount of 2 to 20%, and preferably 3 to 15% by weight, based on polymer.

The colorant (color particles) constituting the electrostatic image developing tone may be subjected to a surface-modifying treatment. Commonly known surface modifiers are usable and specifically, a silane coupling agents, a titanium coupling agent, or an aluminum coupling agent are preferably used.

Silane coupling agents include an alkoxysilane such as methylmethoxysilane, phenyltrimethoxysilane, methylphenyldimethoxysilane and diphenyldimethoxysilane, a siloxane such as hexamethyldisiloxane, γ-chloropropyl-trimethoxysilane, vinyltrichlorosilane, vinyltrimethoxysilane, vinyltriethoxysilane, γ-methacryloxypropyltrimethoxysilane, γ-glycidoxypropyltrimethoxysilane, γ-mercaptopropyl-trimethoxysilane, γ-aminopropyltriethoxysilane, and γ-ureidopropyltriethoxysilane.

Titanium coupling agents include, for example, TTS, 9S, 38S, 41B, 46B, 55, 138S-and 238S which are commercially available, as a trade name "Plain Act", from Ajinomoto Co., Inc.; A-1, B-1, TOT, TST, TAA, TAT, TLA, TOG, TBSTA, A-10, TBT, B-2, B-4, B-7, B-10, TBST, A-400, TTS, TOA-30, TSDMA, TTAB and TTOB which are commercially available from Nippon Soda Co., Ltd. Aluminum coupling agents include, for example, "Plain Act AL-M" (product of Ajinomoto Co., Inc.).

The surface modifier is incorporated preferably in an amount of 0.01% to 20%, and more preferably 0.1% to 5% by weight, based on colorant. Surface modification methods of color particles include, for example, incorporating a surface modifier to a color, particle dispersion and heating to cause a reaction. Surface-modified color particles are filtered off and, after washing with an identical solvent and filtering are repeated, the particles are dried.

Toner particles may contain internal additives such as a charge control agent, other than a mold-releasing agent. Charge control agents contained in the toner particles include, for example, Nigrosine type dyes, metal salts of naphthenic acid or higher fatty acids, an alkoxylated amine, a quaternary ammonium salt compound, an azo type metal complex and a metal salicylate or its metal complex.

Commonly known inorganic particulates are usable as an external additive used for the toner. Specifically, particulate silica, particulate titanium, and particulate aluminum are preferred. Hydrophobic inorganic particulates are preferred. Specific example of particulate silica include R-805, R-976, R-974, R-972, R-812 and R-809, which are commercial available from Nippon Aerogel Co., Ltd.; HVK-2150 and H-200, which are commercially available from Hoechst Co.; TS-72-, TS-530, TS-610, H-5 and MS-5, which are commercially available from Cabot Co., Ltd. Specific examples of particulate titanium include T-805 and T-604, which are commercial available from Nippon Aerogel Co., Ltd.; MT-100S, MT-100B, MT-500BS, MT-600 and MT-600SS, which are commercially available from TIKA Co., Ltd.; TA-300SI, TA-500, TAF-30, TAF-510 and TAF-510T, which are commercially available from Fuji Titan Co., Ltd.; IT-S, IT-OA, IT-OB and IT-OC, which are commercially available from Idemitsu Kosan Corp. Further, specific examples of particulate aluminum include RFY-C and C-604, which are commercial available from Nippon Aerogel Co., Ltd.; and TTO-55, available from ISHIHARA SANGYO KAISHA LTD.

Organic particulates usable as an external additive are spherical particulates having a number-average primary particulate size of 10 to 2000 nm. Examples of constituent material of such organic particulates include polystyrene, polymethylmethacrylate, and styrene-methyl methacrylate copolymer.

Lubricants usable as an external additive include higher fatty acid metal salts. Specific examples thereof include stearic acid metal salts such as zinc stearate, aluminum stearate, copper stearate, magnesium stearate, and calcium stearate; oleic acid metal salts such as zinc oleate, manganese oleate, iron oleate, copper oleate, and magnesium oleate; palmitic acid metal salts such as zinc palmitate, copper palmitate, magnesium palmitate, and calcium palmitate; linolic acid metal salts such as zinc linolate and calcium linolate; ricinolic acid metal salts such as zinc ricinolate and calcium ricinolate.

The amount of an external additive to be added preferably is 0.1 to 5% by weight, based on toner. The process of incorporating an external additive is the step of adding the external additive to dried toner particles. Well known various mixing apparatuses are usable as an apparatus to incorporate an external additive, including a turbulent mixer, a Henschel mixer, a nauter mixer and a V-type mixer.

Next, the toner particle size will be described. The number-average toner particle size is preferably 3 to 10 nm, and more preferably 3 to 8 nm. The particle size can be controlled by adjusting flocculant concentration, organic solvent amount, coalescence time and polymer composition in the process of preparing the toner. A number-average particle size of 3 to 10 μm reduces fine adhesive toner particles which are to be adhered to a heating member, causing off-setting and enhances transfer efficiency, leading to enhanced halftone image quality and enhanced fine-line and dot qualities.

The number-average particle size of the toner can be measured using a Coulter counter TA-11, Coulter multisizer and SLAD1100 (laser diffraction type particle size measurement apparatus, produced by Shimazu Seisakusho). The particle size measurement was conducted using a Coulter multisizer which was connected to an interface outputting a particle size distribution and a personal computer. The Coulter multisizer was used at an aperture of 100 μm and a volume distribution of toner particles of 2 μm or more (e.g., 2 to 40 μm) was measured to determine the particle size distribution and the average particle size.

The shape factor (or shape coefficient) of the toner particles is defined according to the following equation, indicating the degree of roundness of toner particles:

$$\text{Shape factor}=[(\text{maximum diameter}/2)^2\times\pi]/(\text{projected area})$$

wherein when projection of a toner particle onto the plane is sandwiched between two parallel lines, the maximum diameter is the width of the particle at the time when the spacing between two parallel lines is the greatest; and the projected area is the area of the toner particle projected onto the plane. The shape factor can be determined in a manner that toner particles are photographed using an electron-microscope at a magnification factor of 2000 and the obtained electron-micrograph is analyzed using SCANNING IMAGE ANALYZER (product of Nippon Denshi Corp.). The measurement is conducted for 100 toner particles and the shape factor was determined based on the foregoing formula.

In the embodiment, toner particles exhibiting a shape factor of 1.0 to 1.6 preferably account for at least 65%, and more preferably at least 70% by number of all the particles. It is further preferred that toner particles exhibiting a shape factor of 1.2 to 1.6 preferably account for at least 65%, and preferably at least 70% by number of all the particles. Toner particles of a shape factor of 1.0 to 1.6 accounting for at least 65% results in uniform frictional electrostatic property of the developer transporting member without accumulating excessively charged toner particles, making it easy to exchange toner particles on the surface of the developer transporting member and resulting in no problem such as development ghost.

Methods for controlling the shape factor are not specifically limited, and includes, for example, a method of spraying toner particles into a stream of hot air, a method of repeatedly providing mechanical energy by an impact force to toner particles in a gas phase, a method of subjecting a toner into a circulating stream in a non-dissolvable solvent, and a method in which toner particles having a shape factor of 1.0 to 1.6 or 1.2 to 1.6 are prepared and added to a conventional toner so as to fall within the intended range. Alternatively, the shape of the whole is controlled in the stage of preparing a so-called polymerization toner and toner particles having a shape factor of 1.0 to 1.6 or 1.2 to 1.6 are added to a conventional toner to control the shape factor.

It is preferred that, in a histogram of particle size distribution based on number in which the toner particle size is designated D (μm), natural logarithmic lnD is laid off as abscissa and the abscissa is divided into plural groups at an interval of 0.23, the sum (M) of a relative frequency (m1) of toner particles contained in the highest frequency group and the relative frequency (m2) of toner particles contained in the next highest frequency group is at least 70%. At least 70% of the sum (M) of a relative frequency (m1) and a relative frequency (m2) leads to a narrower particle size distribution and occurrence of selective development can definitely be inhibited by the use of such a toner in the imaging process.

In this invention, the foregoing histogram indicating a particle size distribution based on number is one in which the abscissa of natural logarithmic lnD is divided at intervals of 0.23 into plural groups (0.00-0.23: 0.23-0.46: 0.46-0.69: 0.60-0.92: 0.92-1.15: 1.15-1.38: 1.38-1.61: 1.61-1.84: 1.84-2.07: 2.07-2.30: 2.30-2.53: 2.53-2.76 . . . ). Particle size data of a sample which is measured using a Coulter multisizer according to the following condition, are transferred to a computer via an I/O unit and the foregoing histogram is prepared using a particle size distribution analysis program.

Measurement Condition:

(1) Aperture: 100 μm (2) Sample preparation: To 50 to 100 ml of an electrolyte (ISOTON R-11, a product of Coulter Scientific Japan Corp.), an optimum amount of a surfactant (neutral detergent) is added with stirring and 10 to 20 mg of a measurement sample is added thereto; this mixture is dispersed using an ultrasonic homogenizer over a period of 1 min.

Next, toner particles having no corners will be described based on FIGS. 1(*a*), 1(*b*) and 1(*c*). Particles having no corners preferably account for at least 50% and more preferably at least 70% by number of all the toner particles constituting the toner. At least 50% by number of the proportion of the toner particles having no corners reduces voids of the transferred toner layer (powdery layer), leading to enhanced fixability and minimized occurrence of off-set. Further the number of toner particles which are easily abraded or ruptured and toner particles having a charge-concentrated portion is reduced, and the charge distribution becomes narrow, whereby the electrostatic property is stabilized and formation of images exhibiting superior sharpness can be achieved over a long period of time.

Toner particles having no corners, as described herein, refer to those having substantially no projections on which charges concentrate or which tend to be worn down by stress. Namely, as shown in FIG. 1(*a*), the main axis of toner particle T is designated as L. Circle C, having a radius of L/10, which is positioned in toner T, is rolled along the periphery of toner T, while being in contact with the circumference. When it is possible to roll any part of the circle without substantially crossing over the interior circumference of toner T, a toner is designated as "a toner particle having no corner". The expression, "without substantially crossing over the circumference" means that there is at most only one projection at which any part of the rolled circle crosses over the circumference. Further, "the main axis of a toner particle" as described herein refers to the maximum width of the toner particle when the projection image of the toner particle onto a flat plane is placed between two parallel lines. Incidentally, FIGS. 1(*b*) and 1(*c*) show the projection images of a toner particle with corners.

The proportion of toner particles having no corners are measured as follows. First, an image of a magnified toner particle is made employing a scanning type electron microscope. The resultant picture of the toner particle is further magnified to obtain a photographic image at a magnification factor of 15,000. Subsequently, employing the resultant photographic image, the presence and absence of the corners is determined. The measurement is carried out for 100 random toner particles.

Methods for preparing toner particles having no corners are not specifically limited. As described in the method for controlling the shape factor, a method of spraying toner particles into a stream of hot air, a method of repeatedly providing mechanical energy by an impact force to toner particles in a gas phase, and a method of subjecting a toner into a circulating stream in a non-dissolvable solvent are applicable.

With respect to the shape of toner particles obtained by coalescence, the particles preferably exhibit a circularity degree of 0.930 to 0.980, and more preferably 0.940 to 0.975. The circularity degree is defined as below:

Circularity degree={(circumference length determined from a circle equivalent diameter of a particle)/(a circular length of particle projection)}.

Further, the shape factor distribution is preferably narrow and the standard deviation of the shape factor is preferably not more than 0.10, while the CV value, as defined below, is preferably 15 to 25:

CV value={(standard deviation of circularity degree)/(average circularity degree).

An average circularity degree of 0.930 to 0.980 can make the toner particle form irregular, leading to enhanced thermal transfer efficiency and enhanced fixing ability. Thus, enhances fixing ability can be achieved by adjusting the average circularity degree to 0.980 or less. Further, irregularity of particles can be controlled by adjusting the average circularity degree to 0.930 or more, thereby inhibiting fragmentation of particles caused by stress applied during use over a long period of time.

The toner is usable as a single-component developer or a two-component developer. The single-component developers, usable as a nonmagnetic single-component developer or a magnetic single-component developer in which magnetic particles of 0.1 to 0.5 μm are contained in the toner.

A mixture of the toner with a carrier is usable as a two-component developer, in which commonly known materials including metals such as iron, ferrite or magnetite, or alloys of such metals and a metal such as aluminum or lead are usable as magnetic particles of the carrier. Specifically, ferrite is preferred. The magnetic particles preferably exhibit a volume-average particle size of 15 to 100 μm, and more preferably 25 to 80 μm. The volume-average particle size can be determined using, for example, a laser diffraction type particle size distribution measuring apparatus, provided with a wet disperser (HELOS, produced by SYMPATEC Corp.).

A carrier of resin-coated magnetic particles and a so-called resin dispersion type carrier of magnetic particles dispersed in resin are preferred. Resins used for coating are not specifically limited and, for example, olefin type resin, styrene type resin, styrene-acryl type resin, silicone type resin, ester type resin and fluorinated resin are usable. Resins used for the foregoing resin dispersion type carrier are not specifically limited, and include for example, styrene-acryl resin, polyester resin, fluorinated resin and phenol resin.

The toner is preferably used in the image forming method (image forming method of this invention), which comprises allowing an image forming support having a toner image formed thereon to pass between a heating roller and a pressure roller to perform fixing.

FIG. 2 shows a sectional view of an exemplary fixing apparatus used in the foregoing image forming method. The fixing apparatus shown in FIG. 2 is provided with a heating roller (10), which contacts with a pressure roller (20). In FIG. 2, T is a toner image formed on a transfer paper (image forming support). In the heating roller (10), covering layer (12) comprised of fluorinated resin or an elastic body is formed on the surface of mandrel (11) and heating member (13) comprising a linear heater is included. The mandrel (11) is formed of metal, having an inside diameter of 10 to 70 mm. The metal forming the mandrel (11) is not specifically limited and examples thereof include metals such as iron, aluminum and copper and their alloys. The wall thickness of the mandrel (11) is within the range of 0.1 to 15.0 mm, which takes into account balance between the requirement for energy saving (reduction of thickness) and strength (depending on constituent material). For example, to maintain strength equivalent to a 0.8 mm thick iron mandrel with an aluminum mandrel, the wall thickness of 0.8 mm is required.

Examples of fluorinated resin forming the covering layer (12) include polytetrafluoroethylene (PTFE) and tetrafluoroethylene-perfluoroalkyl vinyl ether copolymer (PFA). The thickness of the covering layer (12) formed of fluorinated resin is usually 10 to 500 μm, and preferably 20 to 400 μm. A thickness of less than 10 μm cannot sufficiently function as a coating layer, making it difficult to maintain durability as a fixing apparatus. On the other hand, a thickness of more than 500 μm easily forms abrasion marks due to paper dusts on the coating layer surface, causing image staining due to a toner adhered in the abrasion marks.

Examples of an elastic body forming the coating layer include silicone rubber or silicone sponge rubber exhibiting superior heat resistance, such as LTV, RTV and HTV. The elastic body forming the covering layer (12) exhibits an Asker-C hardness of less than 80° C., and preferably less than 60° C. The thickness of the covering layer (12) formed of an elastic body is usually 0.1 to 30.0 mm, and preferably 0.1 to 20.0 mm. When the Asker-C hardness of an elastic body is more than 80° C. or the thickness of the covering layer (12) is less than 0.1 mm, it becomes difficult to enlarge nip in fixing and a soft fixing effect (for example, enhanced color reproduction due to a smoothed toner layer surface) can be displayed.

A halogen heater is suitable as the heating member (13). The pressure roller (20) is comprised of mandrel (21) having thereon covering layer (22) formed of an elastic body. The elastic body forming the covering layer (22) is not specifically limited, including various soft rubber and sponge rubber such as urethane rubber and silicone rubber. Material forming the covering layer (12) preferably is silicone rubber or silicone sponge rubber. The elastic body forming the covering layer (22) exhibits an Asker-C hardness of less than 80° C., preferably less than 70° C., and more preferably less than 60° C. The thickness of the covering layer (22) formed of an elastic body is usually 0.1 to 30.0 mm, and preferably 0.1 to 20.0 mm. When the Asker-C hardness of an elastic body is more than 80° C. or the thickness of the covering layer (22) is less than 0.1 mm, it becomes difficult to enlarge nip in fixing and therefore a soft fixing effect (for example, enhanced color reproduction due to a smoothed toner layer surface) can be displayed.

Material forming the mandrel (21) is not specifically limited and examples thereof include metals such as aluminum, iron and copper, and their alloys.

The working load (total load) between the heating roller (10) and the pressure roller (20) is usually 40 to 350 N, preferably 50 to 300 N, and more preferably 50 to 250 N. The working load is provided taking into account strength of the heating roller (10), e.g., a wall thickness of the mandrel (11). In the case of a heating roller comprised of a mandrel of 0.3 mm thick iron, the load is provided to be 250N or less.

The nip width is preferably 4 to 10 mm in terms of off-set resistance and fixability, while the contact pressure of the nip is preferably $0.6\times10^5$ to $1.5\times10^5$ Pa.

Fixing conditions of the fixing apparatus shown in FIG. 2 are, for example, a fixing temperature [or surface temperature of the heating roller (10)] of 150 to 210° C. and a fixing linear speed of 80 to 640 mm/sec.

The fixing apparatus may optionally be provided with a cleaning mechanism. In that case, using a pad, roller or web impregnated with silicone oil to perform cleaning, silicone oil is supplied to the upper roller (heating roller) of the fixing section. Highly heat-resistant silicone oils can be used, such as polydimethylsilicone, polyphenylmethylsilicone and polydiphenylsilicone. The use of a low-viscosity oil results in increased effluent so that the use of oils exhibiting a viscosity of 1 to 100 Pa.s at 20° C. is preferred.

Advantageous effects of this invention are markedly displayed when a fixing apparatus supplying little or no silicone oil is used in the process of image formation. Accordingly, even when feeding silicone oil, the feed rate is preferably not more than 2 mg/A4. A silicone oil feed rate of not more than 2 mg/A4 reduces adherence of silicone oil onto the fixed transfer paper (image support), whereby problems, caused by silicone oil adhered to the transfer paper when recorded with an oil-based pen such as a ball-point pen are minimized without degrading writability. Furthermore, there can also be avoided problems such as deteriorated off-set resistance due to secular change of silicone oil and staining of the optical system or the charging electrode. After 100 sheets of transfer paper (white paper of A4 size) are allowed to continuously pass through a fixing apparatus (or between rollers) heated to a prescribed temperature, a weight difference (Δw) of the fixing apparatus between before and after passage of the paper is measured to determine the feed amount of silicone oil (Δw/100).

EXAMPLES

The present invention will be further described based on examples but is by no mean limited to these examples.

Example 1

Latex 1HML, latex 2L (used for shelling) and a colorant dispersion were prepared in the following manner.

Preparation of Latex (1) Preparation of Latex 1H (1st Step Polymerization: Formation of Nucleus Particles)

To a 5000 ml separable flask provided with a stirrer, a temperature sensor, condenser tube and nitrogen introducing device, 1.6 g of a compound of the foregoing formula (1) and a surfactant solution (aqueous medium) of 2.4 g of an anionic surfactant (Neogen SC, product of Dai-ichi Kogyo Kagaku Co., Ltd.) dissolved in 3000 g deionized water were introduced and heated to 80° C. while stirring at a rate of 230 rpm in a stream of nitrogen. To the surfactant solution, a initiator solution of 10 g of a polymerization initiator (potassium persulfate: KPS) dissolved in 400 g deionized water was added and raised to a temperature of 75° C. and then, a monomer mixture solution comprised of 560 g of styrene, 200 g of n-butyl acrylate and 40 g of methacrylic acid was dropwise added over a period of 1 hr. The mixture was heated at 75° C. for 2 hr with stirring to undergo polymerization (1st step polymerization) to obtain a latex (dispersion of resin particles comprised of a high molecular weight resin). This was designated "latex (1H)".

(2) Preparation of Latex 1HM (2nd Step Polymerization: Formation of Interlayer)

To a flask provided with a stirrer containing a monomer solution comprised of 95 g of styrene, 36 g of butyl acrylate, 9 g of methacrylic acid and 0.59 g of n-octyl 3-mercaptopropionate, 77 g of crystalline material, mold-releasing compound 19 exemplified earlier was added and dissolved with heating at 90° C. to obtain a monomer solution 4.

Further, 0.2 g of the compound (1) and 0.3 g of an anionic surfactant (Neogen SC, product of Dai-ichi Kogyo Kagaku Co., Ltd.) were dissolved in 1560 ml of deionized water and heated at 98° C. To this surfactant solution, a nucleus particle solution of the foregoing latex (1H) was added in amount of 28 g solids (i.e., represented by equivalent converted to solids), further thereto, the monomer solution of the exemplified compound (19) was added and dispersed for 8 hr. using a mechanical stirrer having a circulating path (CLEAR MIX, M Technique Co., Ltd.) to obtain a dispersion (emulsion) containing emulsion particles (oil droplets having a dispersion particle size of 284 nm).

Then, to the dispersion (emulsion), 5 g of polymerization initiator (KPS) dissolved in 200 ml deionized water was added and heated at 98° C. for 12 hr. with stirring to perform polymerization (2nd polymerization) to obtain a latex (a dispersion of composite resin particles a structure in which the foregoing resin particles comprised of a high molecular weight resin were covered with an intermediate molecular weight resin). This was designated "latex (1HM)".

(3) Preparation of Latex 1HML (3rd Step Polymerization: Formation of Outer Layer)

To the latex (1HX) obtained was added an initiator solution of 6.8 g of polymerization initiator (KPS) dissolved in 265 ml deionized water. Further thereto, a monomer mixture solution comprised of 249 g of styrene, 88.2 g of n0butyl acrylate, 24.3 g of methacrylic acid and 7.45 g of n-octyl 3-mercaptopropionate was dropwise added over a period of 1 hr. After completing addition, the solution was heated for 1 hr. with stirring to perform polymerization (3rd polymerization) and cooled to 28° C. to a latex, dispersion of composite resin particles formed of a center portion comprised of a high molecular weight resin, an interlayer layer comprised of an intermediate molecular weight resin and an outer layer comprised of a low molecular weight resin, and the interlayer containing the exemplified compound (19). This was designated "latex 1HML".

It was proved that the composite resin particles of the latex 1HML exhibited peak molecular weights at 138,000, 80,000 and 13,000. Further, the weight-average particle size of the composite resin particles was 122 nm.

Preparation of Latex 2L (for Use in Shelling)

To a 5000 ml separable flask provided with a stirrer, a temperature sensor, condenser tube and nitrogen introducing device, 1.6 g of the foregoing compound of formula(1) and a surfactant solution (aqueous medium) of 2.4 g of an anionic surfactant (Neogen SC, product of Dai-ichi Kogyo Kagaku Co., Ltd.) dissolved in 3000 g deionized water were introduced and heated to 80° C. while stirring at a rate of 230 rpm in a stream of nitrogen. To this surfactant solution, a initiator solution of 10 g of a polymerization initiator (potassium persulfate: KPS) dissolved in 400 g deionized water was added and raised to a temperature of 75° C. and then, a monomer mixture solution comprised of 560 g of styrene, 200 g of n-butyl acrylate, 40 g of methacrylic acid and 25 g of n-octyl 3-mercaptoptopionate was dropwise added over a period of 1 hr. The mixture was heated at 75° C. for 2 hr with stirring to undergo polymerization to obtain a dispersion containing resin particles for use in shelling. This was designated "latex 2L".

Dispersion of Colorant

An anionic surfactant (Neogen SC, product of Dai-ichi Kogyo Kagaku Co., Ltd.) of 59.0 g was dissolved in 1600 ml deionized water. To this solution, 420.0 g of carbon black (Regal 330R, product of Cabot Co.) was gradually added with stirring and then dispersed using a mechanical stirrer (CLEAR MIX, M Technique Co., Ltd.) to obtain a dispersion of color particles (hereinafter, denoted as colorant dispersion 1). The color particle size of this dispersion, which was measured using an electrophoresis light scattering photometer (ELS-800, product of Ohtsuka Denshi Co.), was 110 nm.

Preparation of Color Particle 1

Flocculation and coalescence of composite resin particles of latex 1HML and color particles were carried out according to the following procedure. To a reaction vessel (four-bottled flask) provided with a temperature sensor, condenser, nitrogen introducing device and stirrer were added with stirring latex 1HML of 420.7 g (solids content), 900 g of deionized water and 200 g of colorant dispersion 1. After the internal temperature of the vessel was adjusted to 30° C., an aqueous solution of sodium hydroxide was added to the solution to adjust the pH to 8.0 to 11.0.

Subsequently, 12.1 g of magnesium chloride hexahydrate dissolved in 1000 ml deionized water was added at 30° C. over a period of 10 min. with stirring. After being allowed to stand for 3 min., heating was started and the temperature was raised to 90° C. over a period of 60 min. While maintaining this state, the size of coalesced particles were measured using Coulter counter TA-II and when reached a number-average particle of 4 to 7 μm, 40.2 g of sodium chloride dissolved in 1000 ml deionized water was added to stop the growth of the particles. Further, the reaction mixture was ripened at 98° C. for 6 hr. to continue flocculation and coalescence.

Shelling the particles obtained above was conducted in the following manner. After completion of the foregoing flocculation and coalescence of the particles, 96 g of latex 2L (resin particle dispersion used for shelling) was added thereto and stirred for 3 hr. with heating to allow resin particles used for shelling (latex 2L) to be coalesced onto the surface of particles obtained by the foregoing flocculation and coalescence of resin particles of latex 1HML and color particles. Further, 40.2 g of sodium chloride was added and the reaction mixture was cooled to 30° C. at a rate of 8° C./min, the pH was adjusted to 2.0 with hydrochloric acid and stirring was stopped. Particles which were thus formed by the foregoing sating-out, flocculation and coalescence, were filtered, washed using deionized water at 45° C. in an mount of 120 times of the solid content of the color particles and dried with hot air of 40° C. to obtain color particles (denoted as color particle 1).

Preparation of Color Particle 2

Color particles (color particle 2) were prepared similarly to the foregoing color particle 1, provided that the compound of formula (1) used in the preparation of latex (1H), latex (1HM) and latex 2L were each replaced by another compound of formula (1).

Preparation of Color Particles 3 to 15

Color particles 3 was prepared similarly to the foregoing color particle 2, except that contents of the compound of formula (1) used in the preparation of latex (1H), latex (1HM) and latex 2L, or the amount of water used in washing were varied as shown in Table 1.

Preparation of Color Particle 16

Color particle 16 was prepared similarly to the foregoing color particle 1, except that the compound of formula (1) used in the preparation of latex (1H), latex (1HM) and latex 2L were each replaced by comparative compound (6), nonionic surfactant (Nonipol 400, product of Sanyo Kasei Co.).

TABLE 1

| Color | Content of Compound of Formula (1) [g] | | | Amount* of Washing |
|---|---|---|---|---|
| Particle | Latex 1H | Latex 1HM | Latex 2L | Water |
| 1 | 1.6 | 0.2 | 1.6 | 120 |
| 2 | 1.6 | 0.2 | 1.6 | 120 |
| 3 | 0.8 | 0.2 | 0.8 | 500 |
| 4 | 1.6 | 0.2 | 1.6 | 80 |
| 5 | 1.6 | 0.2 | 1.6 | 50 |
| 6 | 1.6 | 0.2 | 1.6 | 40 |
| 7 | 5 | 5 | 5 | 40 |
| 8 | 2.4 | 0.4 | 2.4 | 120 |
| 9 | 1.6 | 0.2 | 1.6 | 120 |
| 10 | 1.6 | 0.2 | 1.6 | 120 |
| 11 | 1.6 | 0.2 | 1.6 | 120 |
| 12 | 1.6 | 0.2 | 1.6 | 120 |
| 13 | 0.2 | 0.2 | 0.2 | 800 |
| 14 | 5 | 5 | 5 | 10 |
| 15 | 1.6 | 0.2 | 1.6 | 120 |
| 16 | 1.6 | 0.2 | 1.6 | 120 |

*multiple of solid content of color particle

Preparation of Toner 1 to 12 and Comparative Toner 13 to 16

To each of the foregoing color particles 1 to 16, 1% by weight of hydrophobic silica (number-average primary particle size of 12 nm, a hydrophobicity degree of 68) and hydrophobic titanium (number-average primary particle size: 20 nm, a hydrophobicity degree of 63) were added and mixed a Henschel mixer to obtain electrostatic image developing toners 1 to 12 and comparative toners 1 to 4. No difference in particle form or size was observed among color particles 1 to 16 or among the toners using the respective color particles.

Compounds of formula (1) contained in the respective toners and physical property values thereof are shown in Table 2.

TABLE 2

| | | Compound of Formula (1) | | | | | Toner | |
|---|---|---|---|---|---|---|---|---|
| Toner No. | Colored Particle | $R_1$ | Content (ppm) | n = 3-6*[1] (%) | HLB (° C.) | Cloud Point (° C.) | Particle Size (μm) | CV Value |
| 1 | 1 | $C_{18}H_{37}$ | 48 | 78 | 16.4 | 60 | 6.5 | 19 |
| 2 | 2 | $C_{12}H_{25}$ | 35 | 80 | 17.8 | 100 | 6.5 | 19 |
| 3 | 3 | $C_{12}H_{25}$ | 1.5 | 79 | 17.8 | 100 | 6.5 | 21 |
| 4 | 4 | $C_{12}H_{25}$ | 120 | 77 | 17.8 | 100 | 6.5 | 19 |
| 5 | 5 | $C_{12}H_{25}$ | 450 | 75 | 17.8 | 100 | 6.5 | 19 |
| 6 | 6 | $C_{12}H_{25}$ | 550 | 72 | 17.8 | 100 | 6.5 | 21 |
| 7 | 7 | $C_{12}H_{25}$ | 950 | 72 | 17.8 | 100 | 6.5 | 22 |
| 8 | 8 | $C_{12}H_{25}$ | 210 | 40 | 17.8 | 100 | 6.5 | 22 |
| 9 | 9 | $C_{12}H_{25}$ | 42 | 95 | 17.8 | 100 | 6.5 | 21 |
| 10 | 10 | $C_{12}H_{25}$ | 56 | 81 | 15.2 | 97 | 6.5 | 20 |
| 11 | 11 | $C_{12}H_{25}$ | 48 | 79 | 14.1 | 80 | 6.5 | 20 |
| 12 | 12 | $C_{12}H_{25}$ | 52 | 80 | 13.1 | 56 | 6.5 | 20 |
| Comp. 1 | 13 | $C_{12}H_{25}$ | 0.4 | 85 | 17.8 | 100 | 6.5 | 25 |
| Comp. 2 | 14 | $C_{12}H_{25}$ | 1050 | 70 | 17.8 | 100 | 6.5 | 24 |
| Comp. 3 | 15 | $C_9H_{19}$ | 80 | 40 | 17.8 | 65 | 6.5 | 25 |
| Comp. 4 | 16 | nonyl-phenyl | 95 | 45 | 5.7 | 70 | 6.5 | 25 |

*[1]Percentage by weight of compound having "n" of 3 to 6

Preparation of Developer

Each of the foregoing toners 1 to 4 and comparative toners 5 and 6 was mixed with ferrite carrier particles coated with silicone resin, having a volume-average particle size of 60 μm to prepare a developer so that the toner concentration was 6%. The thus prepared developers designated developer 1 to 4 and comparative developers 5 and 6.

Characteristics of the developers were evaluated. Thus, using commercially available digital copier Konica Sitios 7075, the respective developers were evaluated with respect to the following line width and crushed print.

Evaluation of Line Width (Fine-line Reproducibility) The line width of line images corresponding to 2 dot line image signals was measured using print evaluation system RT2000 (produced by Yahman Co., Ltd.). When line widths of the image formed on the 1st sheet and the 200,000th sheet were fallen within 200 μm or less and variation in line width was less than 10 μm, the fine-line reproducibility was acceptable.

Crushed Print (Evaluation of Readability)

character images of 3-point and 5-point were formed and evaluation was made according to the following criteria:

A: 3-point and 5-point characters were clear and readily readable,

B: partially unreadable 3-point characters were produced but 5-point characters were clearly readable, C: almost 3-point characters were unreadable and a part or all of 5-point characters were unreadable.

Results obtained are shown in Table 2.

TABLE 3

| Developer No. | Fine-line Reproducibility: Line Width 1st Sheet | Line Width 200,000th Sheet | variation in Line Width | Readability | Remark |
|---|---|---|---|---|---|
| 1 | 180 | 185 | 5 | A | Inv. |
| 2 | 180 | 183 | 3 | A | Inv. |
| 3 | 180 | 185 | 5 | A | Inv. |
| 4 | 180 | 182 | 2 | A | Inv. |
| 5 | 180 | 184 | 4 | A | Inv. |
| 6 | 180 | 187 | 7 | B | Inv. |
| 7 | 181 | 190 | 9 | B | Inv. |
| 8 | 181 | 190 | 9 | B | Inv. |
| 9 | 180 | 187 | 8 | B | Inv. |
| 10 | 180 | 185 | 5 | A | Inv. |
| 11 | 180 | 186 | 6 | A | Inv. |
| 12 | 180 | 186 | 6 | A | Inv. |
| Comp. 1 | 195 | 209 | 14 | C | Comp. |
| Comp. 2 | 202 | 218 | 16 | C | Comp. |
| Comp. 3 | 205 | 220 | 15 | C | Comp. |
| Comp. 4 | 210 | 233 | 23 | C | Comp. |

According to the foregoing examples, as shown in table 2, developers 1 to 12 were superior in fine-line reproducibility and readability, compared to comparative developers 1 to 4.

What is claimed is:

1. A toner comprising toner particles, wherein the toner contains a compound represented by the following formula (1) in an amount of 1 ppm to 1000 ppm:

$$R_1O(R_2O)_nH \qquad \text{formula (I)}$$

wherein $R_1$ is an aliphatic hydrocarbon group having 10 to 22 carbon atoms or a distyrene-substituted phenyl group; $R_2$ is an alkylene group having 2 to 6 carbon atoms; and n is an integer of 1 to 15, and wherein 50% to 90% by weight of the compound represented by formula (1) is accounted for by a compound having n of 3 to 6.

2. The toner of claim 1, wherein the toner contains a mold-releasing agent represented by the following formula in an amount of 2 to 20% by weight based on the toner:

$$R_1—(OCO—R_2)_n$$

wherein $R_1$ and $R_2$ are each a hydrocarbon group having 1 to 40 carbon atoms; and n is an integer of 1 to 4.

3. The toner of claim 1, wherein the toner particles each have multilayer structure comprising a nucleus and a shell.

4. A toner comprising toner particles which are prepared by a process comprising allowing resin particles and color particles to coalesce with each other in an aqueous medium, wherein the toner contains a compound represented by the following formula (1) in an amount of 1 ppm to 1000 ppm:

$$R_1O(R_2O)_nH \qquad \text{formula (1)}$$

wherein $R_1$ is an aliphatic hydrocarbon group having 10 to 22 carbon atoms or a distyrene-substituted phenyl group; $R_2$ is an alkylene group having 2 to 6 carbon atoms; and n is an integer of 1 to 15, and wherein 50% to 90% by weight of the compound represented by formula (1) is accounted for by a compound having n of 3 to 6.

5. The toner of claim 4, wherein the compound represented by formula (1) exhibits a HLB value of 15 to 20.

6. The toner of claim 4, wherein the compound represented by formula (1) exhibits a cloud point of not less than 60° C.

7. The toner of claim 4, wherein in formula (1), $R_1$ is an aliphatic group having 10 to 20 carbon atoms.

8. The toner of claim 4, wherein in formula (1), $R_1$ is an aliphatic group having 10 to 18 carbon atoms.

9. The toner of claim 4, wherein in formula (1), $R_2$ is an alkylene group having 2 to 3 carbon atoms.

10. The toner of claim 4, wherein in formula (1), n is 1 to 10.

11. The toner of claim 4, wherein in formula (1), n is 2 to 5.

12. The toner of claim 4, wherein in formula (1), n is 2 to 3.

13. The toner of claim 4, wherein the compound represented by formula (1) exhibits a HLB value of 17 to 19.

14. The toner of claim 4, wherein the compound represented by formula (1) exhibits a HLB value of 17 to 18.

15. The toner of claim 4, wherein the compound represented by formula (1) exhibits a cloud point of not less than 80°.

16. The toner of claim 4, wherein the compound represented by formula (1) exhibits a cloud point of 85 to 100°.

17. The toner of claim 4, wherein the toner contains the compound represented by formula (1) in an amount of 5 ppm to 500 ppm.

18. The toner of claim 4, wherein the toner contains the compound represented by formula (1) in an amount of 7 ppm to 100 ppm.

19. The toner of claim 4, wherein the toner particles exhibit a number-average particle size of 3 to 10 μm.

20. The toner of claim 4, wherein the toner particles exhibit a number-average particle size of 3 to 8 μm.

21. The toner of claim 4, wherein at least 6500 by number of the toner particles is accounted for by particles exhibiting a shape factor of 1.0 to 1.6, as defined below:

$$\text{shape factor}=[(\text{maximum diameter}/2)^2\times\pi]/(\text{projected area}).$$

22. The toner of claim 21, wherein at least 65% by number of the toner particles is accounted for by particles exhibiting a shape factor of 1.2 to 1.6.

23. The toner of claim 4, wherein at least 50% by number of the toner particles is accounted for by particles having no corners.

24. The toner of claim 4, wherein the toner particles exhibit a circularity degree of 0.93 to 0.98, as defined below:

circularity degree ={(circumference length determined from a circle equivalent diameter of a particle)/(a circular length of particle projection)}.

25. The toner of claim 24, wherein the circularity degree is 0.94 to 0.975.

26. An image forming method comprising:

developing an electrostatic image on an electrostatic image bearing body with a developer comprising a toner as claimed in claim 4 to form a toner image.

27. The image forming method of claim 26, wherein the method further comprises:

forming an electrostatic image on an electrostatic image bearing body and transferring the toner image to a transfer material.

28. The image forming method of claim 26, wherein the method further comprises:

allowing the formed toner image to pass between a pressure member and a heating member.

29. An image forming apparatus for forming an image by developing an electrostatic image on an electrostatic image bearing body with a developer comprising a toner as claimed in claim 4 to form a toner image.

30. The toner of claim 4, wherein the toner contains a mold-releasing agent represented by the following formula in an amount of 2 to 20% by weight based on the toner:

$$R_1—(OCO—R_2)_n$$

wherein $R_1$ and $R_2$ are each a hydrocarbon group having 1 to 40 carbon atoms; and n is an integer of 1 to 4.

31. The toner of claim 4, wherein the toner particles each have multilayer structure comprising a nucleus and a shell.

* * * * *